US010152925B2

(12) United States Patent
Im et al.

(10) Patent No.: US 10,152,925 B2
(45) Date of Patent: Dec. 11, 2018

(54) BACKLIGHT UNIT, DISPLAY APPARATUS HAVING THE SAME, AND IMAGE DISPLAY SYSTEM

(71) Applicant: Samsung Display Co., Ltd., Yongin, Gyeonggi-Do (KR)

(72) Inventors: Taegon Im, Gwangmyeong-si (KR); Min-Soo Choi, Asan-si (KR); Min-Gyu Kim, Asan-si (KR); Youngsup Kwon, Gwangmyeong-si (KR); Eun Chul Shin, Cheonan-si (KR); Dae-Sik Lee, Asan-si (KR)

(73) Assignee: Samsung Display Co., Ltd. (KR)

( * ) Notice: Subject to any disclaimer, the term of this patent is extended or adjusted under 35 U.S.C. 154(b) by 181 days.

(21) Appl. No.: 14/850,773

(22) Filed: Sep. 10, 2015

(65) Prior Publication Data

US 2016/0140912 A1 May 19, 2016

(30) Foreign Application Priority Data

Nov. 14, 2014 (KR) ..... 10-2014-0158704

(51) Int. Cl.
*G09G 3/34* (2006.01)
*G09G 3/00* (2006.01)

(52) U.S. Cl.
CPC ..... *G09G 3/3406* (2013.01); *G09G 3/003* (2013.01); *G09G 3/3426* (2013.01); *G09G 2310/0237* (2013.01); *G09G 2310/0264* (2013.01); *G09G 2310/08* (2013.01); *G09G 2320/062* (2013.01); *G09G 2320/064* (2013.01); *G09G 2320/08* (2013.01); *G09G 2360/16* (2013.01)

(58) Field of Classification Search
CPC ..... G09G 3/003; G09G 3/36; G09G 3/3406; G09G 2310/0237; G09G 2320/064; G09G 2330/021; G09G 3/3426; G09G 2310/0264; G09G 2310/08; G09G 2320/062; G09G 2360/16; H05B 33/0815; H05B 33/083
See application file for complete search history.

(56) References Cited

U.S. PATENT DOCUMENTS 8,624,525 B2 1/2014 Kuo et al.
2004/0070987 A1 4/2004 Iwaki et al.
(Continued)

FOREIGN PATENT DOCUMENTS

CN 103247279 A 8/2013
KR 10-2007-0015857 A 2/2007
(Continued)

*Primary Examiner* — Robert Michaud
(74) *Attorney, Agent, or Firm* — Innovation Counsel LLP

(57) ABSTRACT

A backlight unit includes a light source part including a light-emitting diode array, a DC/DC converter, a driving current controller, and a reference voltage variable part. The backlight unit is operated in a first mode or a second mode. The driving current controller controls a driving current flowing through the light-emitting diode array to have a first current level during the first mode and controls the driving current flowing through the light-emitting diode array to have a second current level during the second mode. The reference voltage variable part applies a first reference voltage to the driving current controller during the first mode and applies a second reference voltage to the driving current controller during the second mode.

14 Claims, 12 Drawing Sheets

(56) References Cited

U.S. PATENT DOCUMENTS

| | | | | |
|---|---|---|---|---|
| 2009/0109166 | A1 | 4/2009 | Lee et al. | |
| 2010/0026201 | A1 | 2/2010 | Byun et al. | |
| 2011/0089860 | A1* | 4/2011 | Kuo | G09G 3/003 315/294 |
| 2013/0050280 | A1* | 2/2013 | Huang | G09G 3/003 345/690 |
| 2013/0113841 | A1* | 5/2013 | Choi | H05B 33/0815 345/690 |
| 2015/0161949 | A1* | 6/2015 | Wang | G09G 3/3406 315/307 |
| 2015/0294615 | A1 | 10/2015 | Zhang et al. | |
| 2015/0334791 | A1* | 11/2015 | Cao | G09G 3/34 315/192 |

FOREIGN PATENT DOCUMENTS

| | | | |
|---|---|---|---|
| KR | 10-1411721 | B1 | 3/2009 |
| KR | 10-2013-0011906 | A | 1/2013 |
| KR | 10-2013-0085261 | A | 7/2013 |
| KR | 10-2013-0131425 | A | 12/2013 |
| KR | 10-2013-0135718 | A | 12/2013 |

* cited by examiner

BACKLIGHT UNIT, DISPLAY APPARATUS HAVING THE SAME, AND IMAGE DISPLAY SYSTEM

CROSS-REFERENCE TO RELATED APPLICATION

This U.S. non-provisional patent application claims priority under 35 U.S.C. § 119 of Korean Patent Application No. 10-2014-0158704, filed on Nov. 14, 2014, the contents of which are hereby incorporated by reference in its entirety.

BACKGROUND

1. Field of Disclosure

The present disclosure relates to a backlight unit, a display apparatus having the same, and an image display system. More particularly, the present disclosure relates to a backlight unit used to display a three-dimensional image, a display apparatus having the backlight unit, and an image display system.

2. Description of the Related Art

A self-emissive display apparatus, such as an organic light emitting diode display (OLED), a field emission display (FED), a vacuum fluorescent display (VFD), a plasma display panel (PDP), etc., is a display apparatus that displays an image by emitting light by itself. A non-self-emissive display apparatus, such as a liquid crystal display (LCD), electrophoretic display, etc., is a display apparatus that displays the image by controlling light emitted from a separate light source.

The non-self-emissive display apparatus includes a backlight unit providing the light, and the backlight unit includes the light source emitting the light. Various light sources, e.g., a cold cathode fluorescent lamp (CCFL), a flat fluorescent lamp (FFL), a light emitting diode (LED), etc., may be used as the light source. The light emitting diode generally has relatively low power consumption and heat emission.

A two-dimensional display apparatus displays a two-dimensional image, and a three-dimensional display apparatus displays a three-dimensional image according to its operational mode. The three-dimensional display apparatus displays a left-eye image and a right-eye image, which respectively correspond to left and right eyes of a viewer. The viewer recognizes the left-eye image through the left eye and the right-eye image through the right eye.

SUMMARY

The present disclosure provides a backlight unit capable of simplifying a structure boosting a driving current flowing through light-emitting diode arrays, a display apparatus, and an image display system.

Embodiments of the present system and method provide a backlight unit including a light source part, a DC/DC converter, a driving current controller, and a reference voltage variable part.

According to an embodiment, the light source part includes a light-emitting diode array. The DC/DC converter is configured to apply a driving voltage to the light-emitting diode array. The driving current controller is configured to control a driving current flowing through the light-emitting diode array to have a first current level during a first mode and controls the driving current flowing through the light-emitting diode array to have a second current level different from the first current level during a second mode different from the first mode. The reference voltage variable part is configured to apply a first reference voltage to the driving current controller during the first mode and applies a second reference voltage different from the first reference voltage to the driving current controller during the second mode.

The driving current controller may include a current control transistor, an amplifier, and a resistor. The current control transistor may include a first terminal connected to the light-emitting diode array. The amplifier may include a first input terminal connected to a second terminal of the current control transistor, a second input terminal connected to the reference voltage variable part, and an output terminal connected to a control terminal of the current control transistor. The resistor may be connected to the second terminal of the current control transistor.

The first reference voltage may have a voltage level lower than a voltage level of the second reference voltage, and the first current level may be lower than the second current level. The resistor may have a constant resistance.

The light-emitting diode array may include a first light-emitting diode array and a second light-emitting diode array connected to the first light-emitting diode array in parallel.

The current control transistor may include a first current control transistor including a first terminal connected to the first light-emitting diode array and a second current control transistor including a first terminal connected to the second light-emitting diode array.

The amplifier may include a first amplifier and a second amplifier. The first amplifier may include a first input terminal connected to a second terminal of the first current control transistor, a second input terminal connected to the reference voltage variable part, and an output terminal connected to a control terminal of the first current control transistor.

The second amplifier may include a first input terminal connected to a second terminal of the second current control transistor, a second input terminal connected to the reference voltage variable part, and an output terminal connected to a control terminal of the second current control transistor.

The second input terminal of the first amplifier may be electrically connected to the second input terminal of the second amplifier.

The resistor may include a first resistor and a second resistor. The first resistor may be connected to the second terminal of the first current control transistor, and the second resistor may be connected to the second terminal of the second current control transistor. The first and second resistors may have the same resistance.

The driving current controller may be further configured to receive a first duty control signal during the first mode and a second duty control signal during the second mode. The second duty control signal may have a duty ratio smaller than a duty ratio of the first duty control signal during the second mode. A period in which the driving current flows through the light-emitting diode array may be controlled in accordance with the duty ratio of the first duty control signal and the second duty control signal.

The reference voltage variable part may include a first reference resistor, a second reference resistor, a switching device, and a third reference resistor.

The first reference resistor may be configured to receive a source voltage through one end thereof. The second reference resistor may be connected between another end of the first reference resistor and a ground. The switching device may be connected to the second reference resistor in series between the other end of the first reference resistor and the ground. The third resistor may be connected to the second reference resistor and the switching device in parallel between the other end of the first reference resistor and the ground. A voltage of the other end of the first reference resistor may be output as the first reference voltage or the second reference voltage according to an ON or OFF operation of the switching device.

The reference voltage variable part may include a first transistor, a second transistor, a first resistor, a second resistor, and a third resistor. The first transistor may include a control terminal configured to receive an enable signal during the second mode and a first terminal connected to a ground. The second transistor may include a control terminal connected to a second terminal of the first transistor and a first terminal connected to the ground. The first resistor may include one end connected to a first node configured to receive a source voltage. The second resistor may include one end connected to another end of the first resistor and another end connected to the second terminal of the second transistor. The third resistor may be connected between the ground and a second node between the first and second resistors.

The reference voltage variable part may be further configured to output the first reference voltage through the second node during the first mode and output the second reference voltage through the second node during the second mode.

The reference voltage variable part may be further configured to receive a first duty control signal and a second duty control signal having a duty ratio smaller than a duty ratio of the first duty control signal, apply the first duty control signal to the driving current controller during the first mode, and apply the second duty control signal to the driving current controller during the second mode.

The reference voltage variable part may include a first transistor, a second transistor, a first resistor, a second resistor, and a third resistor. The first transistor may include a control terminal configured to receive an enable signal during the second mode and a first terminal connected to a ground. The second transistor may include a control terminal connected to a second terminal of the first transistor. The first resistor may be connected between a first terminal of the second transistor and a first node configured to receive a source voltage. The second resistor may be connected between a second terminal of the second transistor and the ground. The third resistor may be connected between a second node connected to the first terminal of the second transistor and the ground.

The reference voltage variable part may be further configured to output the first reference voltage through the second node during the first mode and output the second reference voltage through the second node during the second mode.

The reference voltage variable part may further include a third transistor, a fourth transistor, a first diode, and a second diode.

The third transistor may include a control terminal connected to the control terminal of the second transistor and a first terminal configured to receive the first duty control signal. The fourth transistor may include a control terminal configured to receive the enable signal during the second mode and a first terminal applied with the second duty control signal. The first diode may include one end connected to a second terminal of the third transistor and may be configured to block a current flowing from the first terminal of the third transistor to the second terminal of the third transistor through the third transistor. The second diode may include one end connected to a second terminal of the fourth transistor and another end connected to the first diode and may be configured to block a current flowing from the first terminal of the fourth transistor to the second terminal of the third transistor.

The reference voltage variable part may be further configured to output the first duty control signal through a third node between the first diode and the second diode during the first mode and output the second duty control signal through the third node during the second mode.

Embodiments of the present system and method provide a display apparatus including a display panel and a backlight unit. The display panel is configured to display an image and the backlight unit provides a light to the display panel.

The display panel may display a two-dimensional image during the first mode and displays a three-dimensional image during a second mode.

The display panel may alternately display a left-eye image and a right-eye image by frame during the second mode.

Embodiments of the present system and method provide an image display system that includes a display panel, an image separator, and a backlight unit. The display panel is configured to display a two-dimensional image during a first mode and alternately display a left-eye image and a right-eye image by frame during a second mode. The image separator is configured to provide the left-eye image to a left eye of a viewer and the right-eye image to a right eye of the viewer during the second mode.

The image separator may be a pair of shutter glasses or a barrier panel. The shutter glasses may be configured to open a left-eye shutter during a time period in which the left-eye image is displayed and open a right-eye shutter during a time period in which the right-eye image is displayed. The barrier panel may be disposed on the display panel and may include a light transmitting part configured to transmit the light incident thereto and a light blocking part configured to block the light incident thereto.

According to the above, a horizontal crosstalk phenomenon and a moving line-stain phenomenon may be substantially simultaneously improved.

In addition, since the reference voltage variable part controls the reference voltage, the driving currents flowing through the light-emitting diode arrays may also be controlled.

BRIEF DESCRIPTION OF THE DRAWINGS

The above and other advantages of the present disclosure are readily apparent when the following detailed description is considered in conjunction with the accompanying drawings wherein.

DETAILED DESCRIPTION

Figure 1:
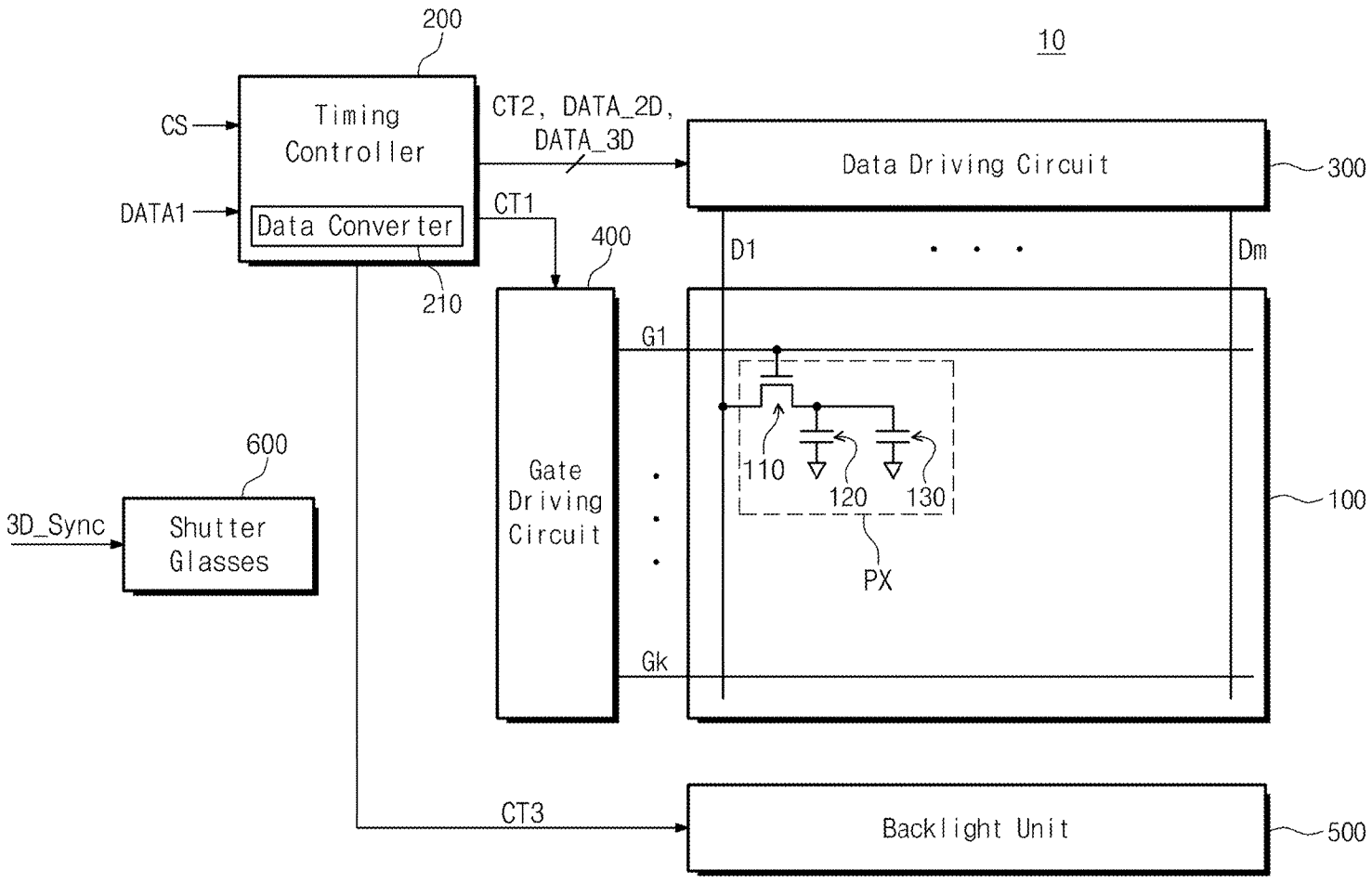
FIG. 1 is a block diagram of a three-dimensional image system, according to an exemplary embodiment of the present disclosure.

When an element or layer is referred to as being "on", "connected to" or "coupled to" another element or layer, it may be directly on, connected or coupled to the other element or layer, or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

Although the terms first, second, etc. may be used herein to describe various elements, components, regions, layers and/or sections, these elements, the components, regions, layers and/or sections are not limited by these terms. These terms are only used to distinguish one element, component, region, layer or section from another element, component, region, layer or section. Thus, a first element, component, region, layer or section discussed below may also be referred to as a second element, component, region, layer or section without departing from the teachings of the present disclosure.

Spatially relative terms, such as "beneath", "below", "lower", "above", "upper" and the like, may be used herein for ease of description to describe one element or feature's relationship to another element(s) or feature(s) as illustrated in the figures. The spatially relative terms encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" encompasses both an orientation of above and below, depending on the orientation of the device relative to that shown in the figures. That is, in whichever way the device may be otherwise oriented (e.g., rotated 90 degrees or at other orientations), the spatially relative descriptors used herein are to be interpreted accordingly.

The terminology used herein for describing the particular embodiments is not limiting of the present disclosure. As used herein, the singular forms, "a", "an" and "the" include the plural forms as well, unless the context clearly indicates otherwise. The terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the meaning as commonly understood by one of ordinary skill in the art to which this disclosure belongs. That is, terms, including those defined in commonly used dictionaries, have a meaning that is consistent with their meaning in the context of the relevant art unless expressly so defined herein.

Hereinafter, the present system and method are explained in detail with reference to the accompanying drawings.

FIG. 1 is a block diagram of a three-dimensional (3D) image system 10, according to an exemplary embodiment of the present disclosure. Referring to FIG. 1, the 3D image system 10 includes a display apparatus and a pair of shutter glasses 600. The display apparatus includes a display panel 100, a timing controller 200, a data driving circuit 300, a gate driving circuit 400, and a backlight unit 500.

The display panel 100 displays an image. The display panel 100 may be a non-self-emissive display panel displaying the image using an external light. For instance, the display panel 100 may be one of a liquid crystal display panel, an electrophoretic display panel, and an electrowetting display panel. Hereinafter, the display panel 100 is described as a liquid crystal display panel as a representative example.

The display panel 100 includes a plurality of gate lines G1 to Gk receiving gate signals and a plurality of data lines D1 to Dm receiving data voltages. The gate lines G1 to Gk are insulated from the data lines D1 to Dm while crossing the data lines D1 to Dm. The display panel 100 includes a plurality of pixel areas arranged in a matrix form and a plurality of pixels each arranged in a corresponding pixel area. FIG. 1 shows an equivalent circuit of one pixel PX among the pixels. The pixel PX includes a thin film transistor 110, a liquid crystal capacitor 120, and a storage capacitor 130.

Although not shown in FIG. 1, the thin film transistor 110 includes a gate electrode, a source electrode, and a drain electrode. The gate electrode is connected to a first gate line G1 among the gate lines G1 to Gk. The source electrode is connected to a first data line D1 among the data lines D1 to Dm. The liquid crystal capacitor 120 and the storage capacitor 130 are connected to the drain electrode in parallel.

In addition, the display panel 100 includes a first display substrate, a second display substrate facing the first display substrate, and a liquid crystal layer interposed between the first and second display substrates.

The first display substrate includes the gate line G1 to Gk, the data lines D1 to Dm, the thin film transistor 110, and a pixel electrode (not shown) serving as a first electrode of the liquid crystal capacitor 120. The thin film transistor 110 applies the data voltage to the pixel electrode in response to the gate signal.

The second display substrate includes a common electrode (not shown) serving as a second electrode of the liquid crystal capacitor 120. The common electrode is applied with a reference voltage. According to another embodiment, the common electrode may be disposed on the first display substrate.

The liquid crystal layer is disposed between the pixel electrode and the common electrode and serves as a dielectric substance. The liquid crystal capacitor 120 is charged with a voltage corresponding to an electric potential difference between the data voltage and the reference voltage.

The display panel 100 displays a two-dimensional (2D) image or a three-dimensional (3D) image according to its operational mode. When the 3D image is displayed, the display panel 100 alternately displays a left-eye image and a right-eye image by frame. Hereinafter, an operational mode in which the display panel 100 displays the 2D image is referred to as a first mode, and an operational mode in which the display panel 100 displays the 3D image is referred to as a second mode.

The timing controller 200 receives image data DATA1 and control signals from an external source (not shown). The control signals include a vertical synchronization signal as a frame distinction signal, a horizontal synchronization signal as a row distinction signal, a data enable signal to indicate a data input period (e.g., data enable signal is maintained at a high level when the image data DATA1 are available), a main clock signal, a 2D image enable signal for operating the display panel 100 in the first mode to display the 2D image, and a 3D image enable signal for operating the display panel 100 in the second mode to display the 3D image.

The timing controller 200 converts the data format of the image data DATA1 to a data format appropriate to the specification of the data driver circuit 300. The timing controller 200 includes a data converter 210.

In response to the 2D image enable signal, the timing controller 200 applies the converted image data to the data driving circuit 300 as 2D image data DATA_2D. In response to the 3D image enable signal, the data converter 210 generates left-eye image data and right-eye image data based on the image data DATA1. The timing controller 200 converts the data format of each of the left-eye image data and the right-eye image data to a data format appropriate to the specification of the data driving circuit 300 and applies the converted left-eye image data and the converted right-eye image data to the data driving circuit 300 as 3D image data DATA_3D.

Each of the left-eye image data and the right-eye image data may be frame data. The left-eye image data are used to display the image perceived by a left eye of a viewer, and the right-eye image data are used to display the image perceived by a right eye of the viewer.

According to another embodiment, the data converter 210 may be configured to be separated from the timing controller 200. For instance, the data converter 210 may be built in a set-top box connected to the display apparatus. In this case, the timing controller 200 converts the data format of the data provided from the data converter 210 and applies the converted data to the data driving circuit 300.

The timing controller 200 generates a gate control signal CT1, a data control signal CT2, and a backlight control signal CT3 based on the control signals CS. The timing controller 200 applies the gate control signal CT1, the data control signal CT2, and the backlight control signal CT3 to the gate driving circuit 400, the data driving circuit 300, and the backlight unit 500, respectively.

The gate control signal CT1 is used to control the operation of the gate driving circuit 400. The gate control signal CT1 includes a scan start signal indicating the start of a scan operation, one or more clock signals controlling an output period of a gate-on voltage, and an output enable signal limiting a time duration of the gate-on voltage.

The data control signal CT2 is used to control the operation of the data driving circuit 300. The data control signal CT2 includes a horizontal start signal indicating a transmission of the 2D and 3D image data DATA_2D and DATA_3D to the data driving circuit 300, a load signal indicating application of the data voltages to the data lines D1 to Dm, and an inversion signal inverting the polarity of the data voltages with respect to the common voltage.

The backlight control signal CT3 is used to control the operation of the backlight unit 500. The backlight control signal CT3 includes a 3D enable signal for operating the display panel 100 in the second mode and a duty control signal determining a duty ratio of the backlight unit 500.

The data driving circuit 300 generates grayscale voltages in accordance with the 2D image data DATA_2D or the 3D image data DATA_3D and applies the grayscale voltages to the data lines D1 to Dm as the data voltages.

During the second mode, the data driving circuit 300 converts the left-eye image data of the 3D image data DATA_3D to left-eye data voltages and converts the right-eye image data of the 3D image data DATA_3D to right-eye data voltages. The data driving circuit 300 applies the left-eye data voltages to the data lines D1 to Dm during a left-eye frame period and applies the right-eye data voltages to the data lines D1 to Dm during a right-eye frame period.

The gate driving circuit 400 generates the gate signals in response to the gate control signal CT1 and applies the gate signals to the gate lines G1 to Gk.

The backlight unit 500 is disposed under the display panel 100. The backlight unit 500 provides the light to the display panel 100 in response to the backlight control signal CT3.

A maximum brightness of the backlight unit 500 operated in the first mode is smaller than a maximum brightness of the backlight unit 500 operated in the second mode. In addition, a duty ratio of the backlight unit 500 operated in the first mode is greater than a duty ratio of the backlight unit 500 operated in the second mode.

The shutter glasses 600 include a left-eye shutter (not shown) and a right-eye shutter (not shown). The shutter glasses 600 receive a 3D synchronization signal 3D_sync. Here, the 3D synchronization signal 3D_sync is a signal synchronized with a driving timing of the display panel 100 operated in the second mode.

In response to the 3D synchronization signal 3D_sync, the shutter glasses 600 open the left-eye shutter during the left-eye frame period and open the right-eye shutter during the right-eye frame period. When the viewer wears the shutter glasses 600, the viewer recognizes the 3D image displayed in the display panel 100 through the left- and right-eye shutters. Particularly, the viewer recognizes the left-eye image during the left-eye frame period and recognizes the right-eye image during the right-eye frame period.

Figure 2:
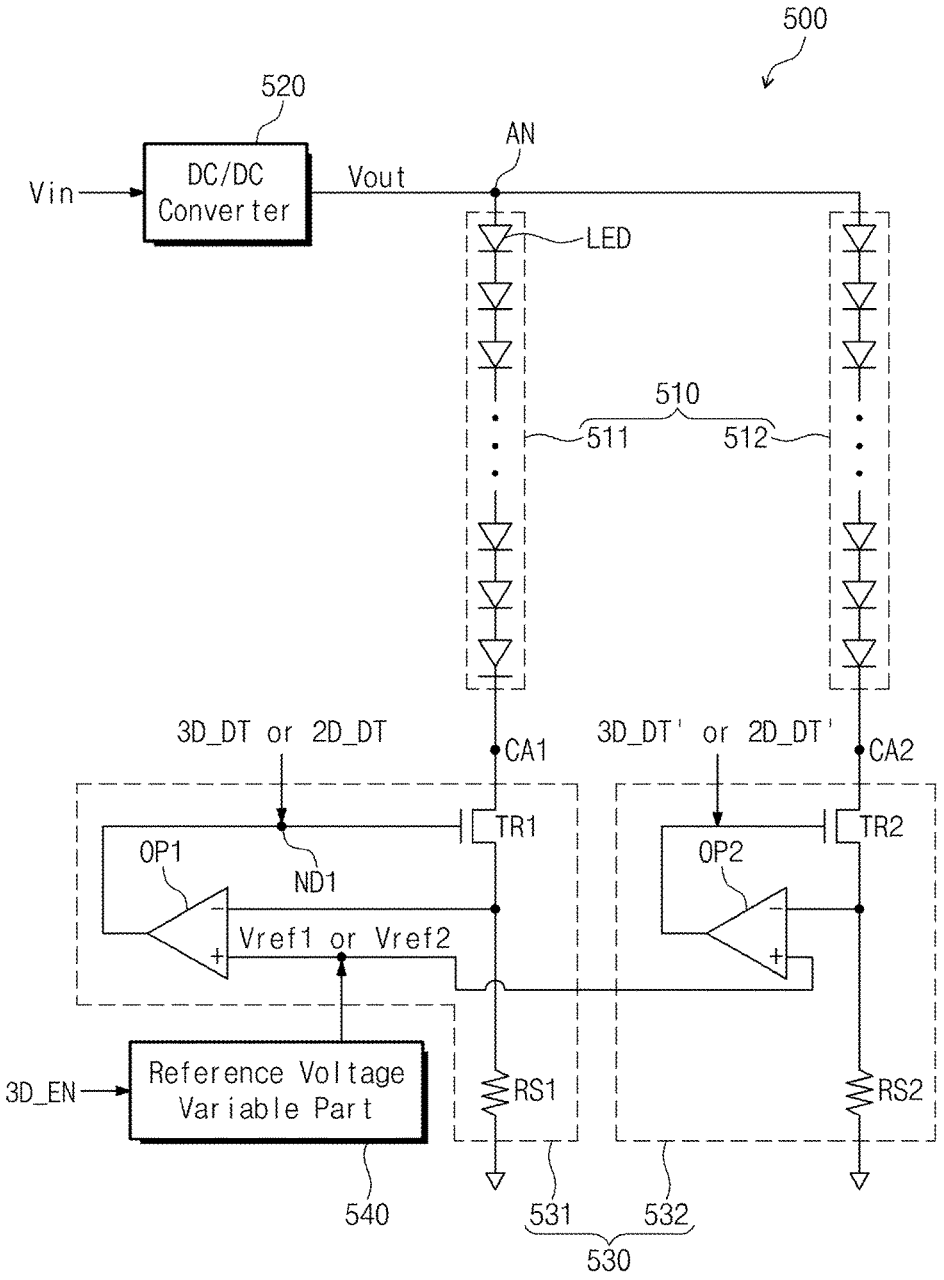
FIG. 2 is a block diagram of the backlight unit shown in FIG. 1, according to an exemplary embodiment of the present disclosure.

FIG. 2 is a block diagram of the backlight unit shown in FIG. 1, according to an exemplary embodiment of the present disclosure. Referring to FIG. 2, the backlight unit 500 includes a light source part 510 and a light source driving part.

The light source part 510 includes one or more light-emitting diode arrays. In the exemplary embodiment of FIG. 2, the light source part 510 includes a first light-emitting diode array 511 and a second light-emitting diode array 512, but the number of light-emitting diode arrays is not limited to two. For example, according to another embodiment, the light source part 510 may include three or more light-emitting diode arrays.

The first and second light-emitting diode arrays 511 and 512 are connected to each other in parallel. Each of the first and second light-emitting diode arrays 511 and 512 includes a plurality of light emitting diodes LED connected to each other in series. The first light-emitting diode array 511 has a light-emitting brightness determined by a current caused by a difference in voltage between an anode terminal AN and a cathode terminal CA1. The second light-emitting diode array 512 has a light-emitting brightness determined by a current caused by a difference in voltage between an anode terminal AN and a cathode terminal CA2.

The light source driving part includes a DC/DC converter 520, a driving current controller 530, and a reference voltage variable part 540.

The DC/DC converter 520 receives an input voltage Vin, generates a driving voltage Vout, and applies the driving voltage Vout to the anode terminal AN of the first and second light-emitting diode arrays 511 and 512. The driving voltage Vout and the input voltage Vin are direct current voltages and have different voltage levels from each other. For instance, the driving voltage Vout may have a higher voltage level than that of the input voltage Vin.

The driving current controller 530 controls the driving current flowing through the first and second light-emitting diode arrays 511 and 512. The driving current controller 530 includes a first driving current controller 531 and a second driving current controller 532.

The first driving current controller 531 controls the driving current flowing through the first light-emitting diode array 511, and the second driving current controller 532 controls the driving current flowing through the second light-emitting diode array 512.

When the backlight unit 500 is operated in the first mode, the first driving current controller 531 controls the driving current flowing through the first light-emitting diode array 511 to have a first level. When the backlight unit 500 is operated in the second mode, the first driving current controller 531 controls the driving current flowing through the first light-emitting diode array 511 to have a second level different from the first level. In the case of FIG. 2, the second level is higher than the first level. That is, the first driving current controller 531 allows a higher driving current to flow through the first light-emitting diode arrays 511 when the display panel 100 displays the 3D image and a lower driving current to flow through the same when the display panel 100 displays the 2D image.

The first driving current controller 531 includes a first current control transistor TR1, a first amplifier OP1, and a first resistor RS1.

The first current control transistor TR1 may be a three-terminal device configured to include a first terminal, a second terminal, and a control terminal. The first current control transistor TR1 may be a field effect transistor (FET) or a bipolar junction transistor (BJT). For instance, the first current control transistor TR1 may be a metal oxide semiconductor field effect transistor (MOSFET) having an n-channel, in which case the first, second, and control terminals of the first current control transistor TR1 are a drain terminal, a source terminal, and a gate terminal, respectively. The first current control transistor TR1 is operated in a region (i.e., ohmic region) in which a current flowing through the first terminal increases when a voltage between the first and second terminals increases.

The first terminal of the first current control transistor TR1 is connected to the cathode terminal CA1 of the first light-emitting diode array 511.

The first amplifier OP1 includes a first input terminal, a second input terminal, and an output terminal. The first input terminal of the first amplifier OP1 is connected to the second terminal of the first current control transistor TR1. The second input terminal of the first amplifier OP1 is connected to the reference voltage variable part 540. The output terminal of the first amplifier OP1 is connected to the control terminal of the first current control transistor TR1. In FIG. 2, the first input terminal is an inverting terminal and the second input terminal is a non-inverting terminal, but they are not limited thereto or thereby. That is, according to another embodiment, the first and second input terminals may be the non-inverting terminal and the inverting terminal, respectively.

The first amplifier OP1 may be, but not limited to, a differential amplifier. The first amplifier OP1 amplifies a voltage difference between a reference voltage output from the reference voltage variable part 540 and the voltage at the second terminal of the first current control transistor TR1.

The first resistor RS1 is connected to the second terminal of the first current control transistor TR1. The first resistor RS1 has a constant resistance.

The first driving current controller 531 receives a duty control signal, which may be 3D_DT or 2D_DT, depending on the mode of operation of the display panel 100. The duty control signal alternates between a high state, i.e., a high level, and a low state, i.e., a low level. The first light-emitting diode array 511 emits light during the high state of the duty control signal and does not emit the light during the low state of the duty control signal.

Figure 3:
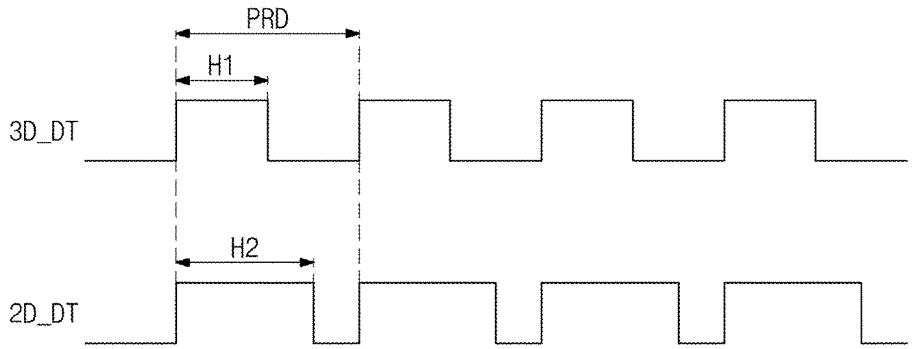
FIG. 3 is a timing diagram of a two-dimensional duty control signal and a three-dimensional duty control signal, according to an exemplary embodiment of the present disclosure.

FIG. 3 is a timing diagram showing a 2D duty control signal 2D_DT and a 3D duty control signal 3D_DT, according to an exemplary embodiment of the present disclosure.

Referring to FIGS. 2 and 3, the duty control signal may be either the 2D duty control signal 2D_DT or the 3D duty control signal 3D_DT. The 2D duty control signal 2D_DT controls the duty ratio of the backlight unit 500 operated in the first mode, and the 3D duty control signal 3D_DT controls the duty ratio of the backlight unit 500 operated in the second mode. That is, when the backlight unit 500 is operated in the first mode, the period in which the driving current flows through the first light-emitting diode array 511 is controlled in accordance with the duty ratio of the 2D duty control signal 2D_DT, and when the backlight unit 500 is operated in the second mode, the period in which the driving current flows through the second light-emitting diode array 512 is controlled in accordance with the duty ratio of the 3D duty control signal 3D_DT.

The 3D duty control signal 3D_DT has a duty ratio smaller than that of the 2D duty control signal 2D_DT. That is, if the 2D duty control signal 2D_DT and the 3D duty control signal 3D_DT have substantially the same period PRD shown in FIG. 3, a time interval H1 during which the 3D duty control signal 3D_DT is maintained at the high state in each period PRD is smaller than a time interval H2 during which the 2D duty control signal 2D_DT is maintained at the high state in each period PRD.

Referring to FIGS. 1 to 3 again, the timing controller 200 outputs the 2D duty control signal 2D_DT during the first mode and outputs the 3D duty control signal 3D_DT during the second mode.

In the exemplary embodiment of FIG. 2, the duty control signal may be applied to a node ND1 connected to the control terminal of the first current control transistor TR1.

According to another embodiment, the duty control signal may be applied to the first terminal of the first current control transistor TR1.

When the backlight unit 500 is operated in the first mode, the backlight unit 500 has a higher duty ratio but lower level of current flowing through the first light-emitting diode array 511 than when the backlight unit 500 is operated in the second mode. Accordingly, the average brightness of the backlight unit 500 operated in the first mode and the average brightness of the backlight unit 500 operated in the second mode may be substantially the same.

The second driving current controller 532 includes a second current control transistor TR2, a second amplifier OP2, and a second resistor RS2.

The second input terminal of the first amplifier OP1 is electrically connected to a second input terminal of the second amplifier OP2. Therefore, the reference voltage Vref output from the reference voltage variable part 540 is applied to both the second input terminal of the first amplifier OP1 and the second input terminal of the second amplifier OP2.

The second driving current controller 532 has substantially the same configuration as that of the first driving current controller 531, and thus details thereof are omitted.

The duty control signal may be applied to the control terminal of the second current control transistor TR2. The duty control signal may be either a 2D duty control signal 2D_DT' or a 3D duty control signal 3D_DT'. In the exemplary embodiment of FIG. 2, the 2D duty control signal 2D_DT' and the 3D duty control signal 3D_DT' applied to the first driving current controller 531 may be substantially the same as the 2D duty control signal 2D_DT and the 3D duty control signal 3D_DT applied to the second driving current controller 532.

According to another embodiment, the 2D duty control signal 2D_DT' and the 3D duty control signal 3D_DT' applied to the first driving current controller 531 may be obtained by controlling the timing of the 2D duty control signal 2D_DT and the 3D duty control signal 3D_DT applied to the second driving current controller 532.

According to another embodiment, a local dimming function may be realized by controlling the timing of the duty control signals first and second driving current controllers 531 and 532.

Referring to FIG. 2, the reference voltage variable part 540 is connected to the second input terminal of the first amplifier OP1. The reference voltage variable part 540 outputs a first reference voltage Vref1 or a second reference voltage Vref2, depending on whether a 3D enable signal 3D_EN is provided.

When the backlight unit 500 is operated in the first mode (e.g., 3D enable signal 3D_EN is not provided), the reference voltage variable part 540 applies the first reference voltage Vref1 to the second input terminal of the first amplifier OP1. When the backlight unit 500 is operated in the second mode (e.g., 3D enable signal 3D_EN is provided), the reference voltage variable part 540 applies the second reference voltage Vref2 different from the first reference voltage Vref1 to the second input terminal of the first amplifier OP1. The first reference voltage Vref1 has a voltage level lower than that of the second reference voltage Vref2.

When the reference voltage variable part 540 outputs the second reference voltage Vref2, the difference in voltage between the first and second input terminals of the first amplifier OP1 is decreased compared to that when the reference voltage variable part 540 outputs the first reference voltage Vref1, and the level of the voltage applied to the control terminal of the first current control transistor TR1 is lowered. Thus, the resistance of the first current control transistor TR1 is increased and the voltage level of the cathode terminal CA1 of the first light-emitting diode array 511 is lowered. Since the difference in voltage between the anode terminal AN and the cathode terminal CA1 of the first light-emitting diode array 511 becomes greater, the driving current flowing through the first light-emitting diode array 511 becomes higher.

Figure 4:
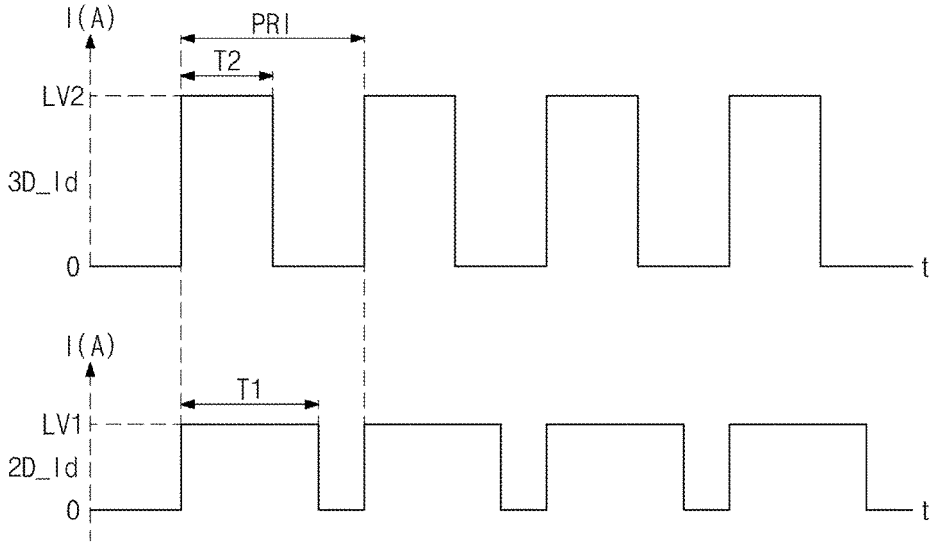
FIG. 4 is a timing diagram of a driving current flowing through a light-emitting diode array in first and second modes, according to an exemplary embodiment of the present disclosure.

FIG. 4 is a timing diagram showing a driving current flowing through a light-emitting diode array in first and second modes, according to an exemplary embodiment of the present disclosure.

Referring to FIGS. 2 to 4, when the backlight is operating in the first mode, the driving current flows through the first and second light-emitting diode arrays 511 and 512 during a first time interval T1 in each period PRI. The driving current 2D_Id flowing through the first and second light-emitting diode arrays 511 and 512 has the first level Lv1 during the first mode. When the backlight is operating in the second mode, the driving current flows through the first and second light-emitting diode arrays 511 and 512 during a second time interval T2 in each period PRI. The driving current 3D_Id flowing through the first and second light-emitting diode arrays 511 and 512 has the second level Lv2 during the second mode.

The second level LV2 is higher than the first level Lv1. The first level Lv1 corresponds to the level of the first reference voltage Vref1, and the second level Lv2 corresponds to the level of the second reference voltage Vref2.

The first period T1 is greater than the second period T2. The one period PRI of the driving current is the same in the first and second modes. The duty ratio (hereinafter, referred to as a first duty ratio) of the driving current 2D_Id flowing through each of the first and second light-emitting diode arrays 511 and 512 during the first mode is greater than the duty ratio (hereinafter, referred to as a second duty ratio) of the driving current 3D_Id flowing through each of the first and second light-emitting diode arrays 511 and 512 during the second mode. The first duty ratio is determined in accordance with the duty ratio of the 2D duty control signal 2D_DT, and the second duty ratio is determined in accordance with the duty ratio of the 3D duty control signal 3D_DT.

Figure 5:
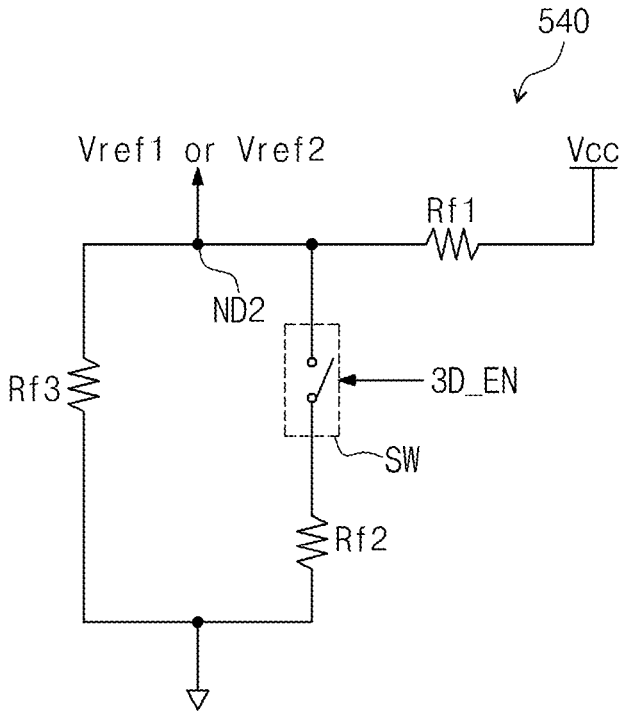
FIG. 5 is a circuit diagram of the reference voltage variable part shown in FIG. 2, according to an exemplary embodiment of the present disclosure.

FIG. 5 is a circuit diagram of the reference voltage variable part 540 shown in FIG. 2, according to an exemplary embodiment of the present disclosure.

Referring to FIG. 5, the reference voltage variable part 540 includes a first reference resistor Rf1, a second reference resistor Rf2, a third reference resistor Rf3, and a switching device SW.

The first reference resistor Rf1 receives a source voltage Vcc from a voltage source through one end thereof. The switching device SW and the second reference resistor Rf2 are connected to each other in series between the other end ND2 of the first reference resistor Rf1 and a ground. The third reference resistor Rf3 is connected between the other end ND2 of the first reference resistor Rf1 and the ground and connected to the second reference resistor Rf2 and the switching device SW in parallel. A voltage at the other end ND2 of the first reference resistor Rf1 is output as the first reference voltage Vref1 or the second reference voltage Vref2.

The switching device SW is turned on or turned off in response to the 3D enable signal 3D_EN. The 3D enable signal 3D_EN is applied during the second mode. The switching device SW is realized by a transistor.

During the first mode, the switching device SW does not receive the 3D enable signal 3D_EN and is turned on. Thus, the other end ND2 of the first reference resistor Rf1 has the first reference voltage Vref1 during the first mode. The second and third reference resistors Rf2 and Rf3 are connected to each other in parallel to form a combined resistance. The combined resistance of the second and third reference resistors Rf2 and Rf3 are connected to the first reference resistor Rf1 in series. The first reference voltage Vref1 is determined by voltage-dividing the source voltage Vcc according to the combined resistance of the second and third reference resistors Rf2 and Rf3 and the first reference resistor Rf1. The first reference voltage Vref1 is determined by the following equation of $Vref1=Vcc\times(Rf2\cdot Rf3)/(Rf2\cdot Rf3+Rf1\cdot Rf2+Rf1\cdot Rf3)$.

During the second mode, the switching device SW receives the 3D enable signal 3D_EN and is turned off. Thus, the other end ND2 of the first reference resistor Rf1 has the second reference voltage Vref2 during the second mode. The first and third reference resistors Rf1 and Rf3 are connected to each other in series. The second reference voltage Vref2 is determined by voltage-dividing the source voltage Vcc according to the third and first reference resistors Rf3 and Rf1. The second reference voltage Vref2 is determined by the following equation of $Vref2=Vcc\times Rf3/(Rf1+Rf3)$. The first reference voltage Vref1 has a voltage level lower than that of the second reference voltage Vref2.

According to an exemplary embodiment, the reference voltage applied to the second input terminal of the first and second amplifiers OP1 and OP2, and thus the driving current flowing through the first and second light-emitting diode arrays 511 and 512, may have different levels according to the first and second modes. That is, when the reference voltage variable part 540 controls the reference voltage, the driving current flowing through the first and second light-emitting diode arrays 511 and 512 included in the light source part 510 is also controlled.

Figure 6:
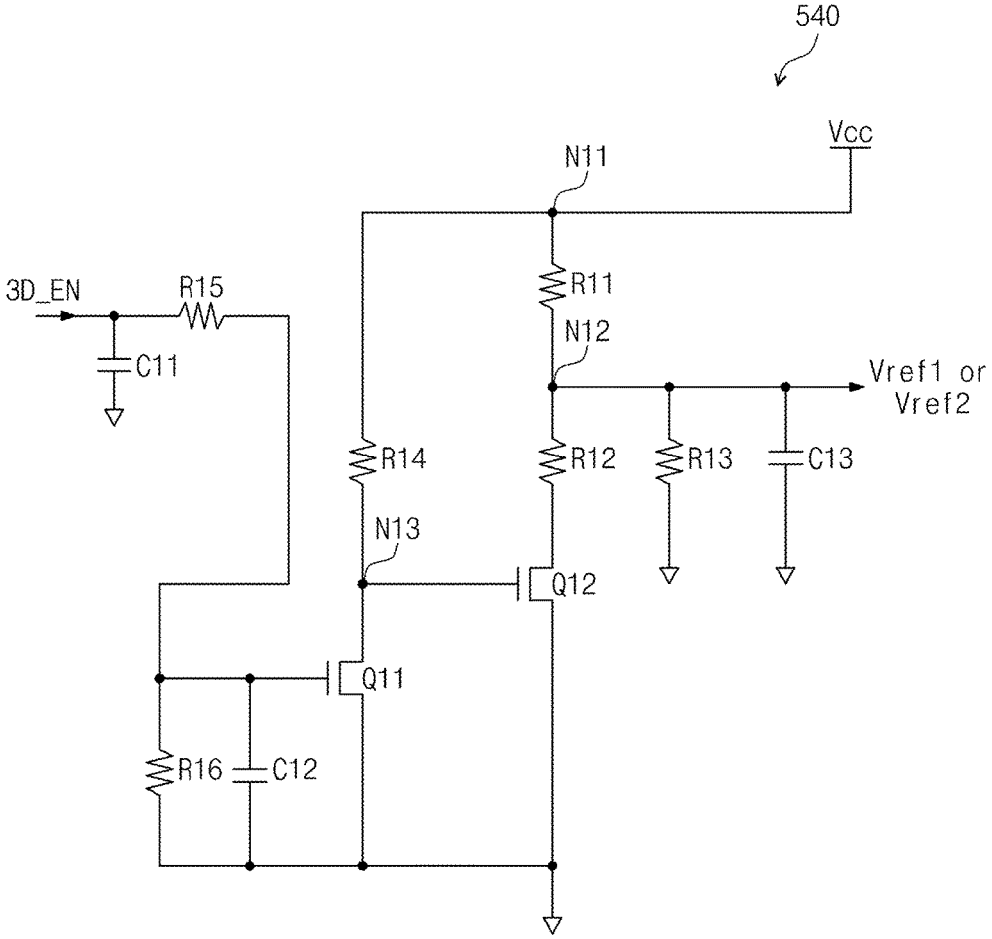
FIG. 6 is a circuit diagram of the reference voltage variable part shown in FIG. 2, according to another exemplary embodiment of the present disclosure.

FIG. 6 is a circuit diagram of the reference voltage variable part 540 shown in FIG. 2, according to another exemplary embodiment of the present disclosure. Referring to FIG. 6, the reference voltage variable part 540 includes a first transistor Q11, a second transistor Q12, first to sixth resistors R11 to R16, and first to third capacitors C11 to C13.

Each of the first and second transistors Q11 and Q12 may be a three-terminal device configured to include a first terminal, a second terminal, and a control terminal. Each of the first and second transistors Q11 and Q12 may be a field effect transistor (FET) or a bipolar junction transistor (BJT). For instance, each of the first and second transistors Q11 and Q12 may be a transistor having an n-channel. When each of the first and second transistors Q11 and Q12 is the field effect transistor, the first, second, and control terminals of each of the first and second transistors Q11 and Q12 are a drain terminal, a source terminal, and a gate terminal, respectively.

The first terminal of the first transistor Q11 is connected to the control terminal of the second transistor Q12. The second terminal of the first transistor Q11 is connected to the ground. The control terminal of the first transistor Q11 receives the 3D enable signal 3D_EN through the fifth resistor R15 during the second mode. The fifth resistor R15 removes noise from the 3D enable signal 3D_EN. The first terminal of the second transistor Q12 is connected to the ground. The second terminal of the second transistor Q12 is connected to the second resistor R12.

One end of the first resistor R11 is connected to a first node N11 and the other end of the first resistor R11 is connected to the second resistor R12. One end of the second resistor R12 is connected to the other end of the first resistor R11 and the other end of the second resistor R12 is connected to the second terminal of the second transistor Q12.

The third resistor R13 is connected between a second node N12 and the ground. The second node N12 is disposed between the first and second resistors R11 and R12. The fourth resistor R14 is connected between the first node N11 and the first terminal of the first transistor Q11. The sixth resistor R16 is connected between the control terminal of the first transistor Q11 and the ground.

The first capacitor C11 is connected between the one end of the fifth resistor R15 and the ground to maintain a waveform of the 3D enable signal 3D_EN. The second capacitor C12 is connected between the control terminal of the first transistor Q11 and the ground to maintain a waveform of the voltage applied to the control terminal of the first transistor Q11. The third capacitor C13 is connected between the second node N12 and the ground to maintain a waveform of the voltage at the second node N12.

The reference voltage variable part 540 outputs the first reference voltage Vref1 or the second reference voltage Vref2 through the second node N12.

Hereinafter, the case in which the 3D enable signal 3D_EN is not provided during the first mode is described. In this case, the first reference voltage Vref1 is output from the second node N12.

When the 3D enable signal 3D_EN is not applied, the first transistor Q11 is turned off, and a third node N13 connected to the first terminal of the first transistor Q11 is pulled-up to the level of the source voltage Vcc. The source voltage Vcc is applied to the control terminal of the second transistor Q12, and thus the second transistor Q12 is turned on. The second and third resistors R12 and R13 are connected to each other in parallel to form the combined resistance. The combined resistance of the second and third resistors R12 and R13 is connected to the first resistor R11 in series. The first reference voltage Vref1 is determined by voltage-dividing the source voltage Vcc in accordance with the combined resistance of the second and third resistors R12 and R13 connected to each other in parallel and the first resistor R11. The first reference voltage Vref1 is determined by the following equation of $Vref1=Vcc\times(R12\cdot R13)/(R12\cdot R13+R11\cdot R12+R11\cdot R13)$.

Hereinafter, the case in which the 3D enable signal 3D_EN is provided during the second mode is described. In this case, the second reference voltage Vref2 is output from the second node N12.

When the 3D enable signal 3D_EN is applied, the first transistor Q11 is turned on, and the third node N13 connected to the first terminal of the first transistor Q11 is grounded. The control terminal of the second transistor Q12 is turned off, and thus a current does not flow through the second resistor R12. The first and third resistors R11 and R13 are connected to each other in series. The second reference voltage Vref2 is determined by voltage-dividing the source voltage Vcc in accordance with the first and third resistors R11 and R13. The second reference voltage Vref2 is determined by the following equation of $Vref2=Vcc\times R13/(R11+R13)$.

Figure 7:
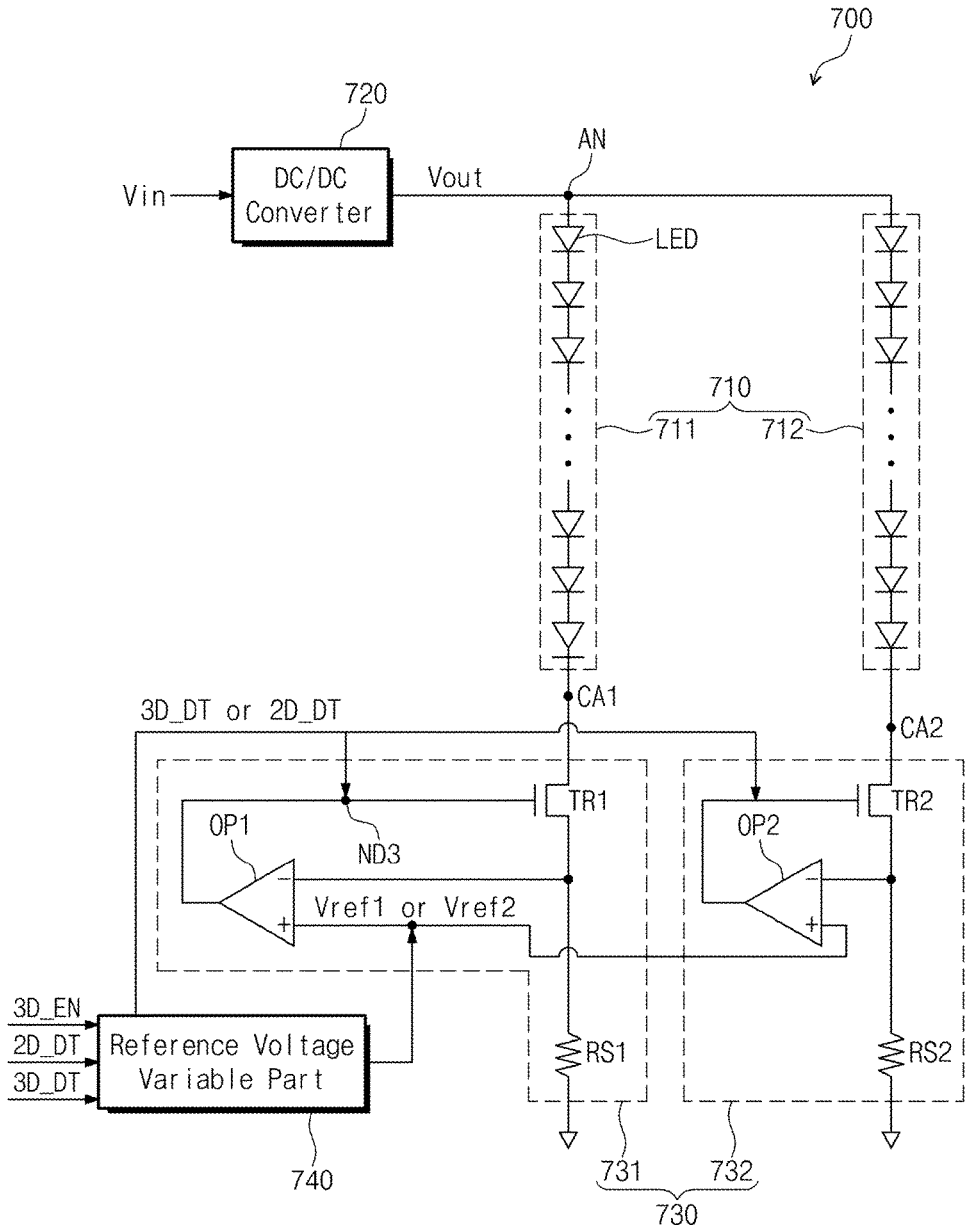
FIG. 7 is a block diagram of the backlight unit shown in FIG. 1, according to another exemplary embodiment of the present disclosure.

FIG. 7 is a block diagram of a backlight unit 700, according to another exemplary embodiment of the present disclosure. Hereinafter, features of the backlight unit 700 shown in FIG. 7 that are different from those of the backlight unit 500 shown in FIG. 2 are described. Referring to FIG. 7, the backlight unit 700 includes a light source part 710 and a light source driving part.

The light source part 710 includes a first light-emitting diode array 711 and a second light-emitting diode array 712. Detailed descriptions of the light source part 710 are omitted since the light source part 710 is substantially the same as the light source part 510 shown in FIG. 2.

The light source driving part includes a DC/DC converter 720, a driving current controller 730, and a reference voltage variable part 740. Detailed descriptions of the DC/DC converter 720 and the driving current controller 730 are omitted since the DC/DC converter 720 and the driving current controller 730 are substantially the same as the DC/DC converter 520 and the driving current controller 530 shown in FIG. 2.

The reference voltage variable part 740 receives the 3D enable signal 3D_EN and outputs the first reference voltage Vref1 or the second reference voltage Vref2 in response to the 3D enable signal 3D_EN as the reference voltage. The first and second reference voltages Vref1 and Vref2 are substantially the same as those described with reference to FIG. 2.

The reference voltage variable part 740 receives the 2D duty control signal 2D_DT and the 3D duty control signal 3D_DT from the timing controller 200 (refer to FIG. 1). The reference voltage variable part 740 applies the 2D duty control signal 2D_DT to the driving current controller 730 during the first mode and the 3D duty control signal 3D_DT to the driving current controller 730 during the second mode. The 2D duty control signal 2D_DT and the 3D duty control signal 3D_DT are substantially the same as those described with reference to FIGS. 2 and 3. The reference voltage variable part 740 controls the timing of the duty control signal (2D_DT or 3D_DT) respectively applied to first and second driving current controllers 731 and 732.

The reference voltage variable part 740 shown in FIG. 7 controls the voltage level of the reference voltage applied to the driving current controller 730 according to the first and second modes. As a result, the driving current flowing through the first and second light-emitting diode arrays 711 and 712 during the second mode may be boosted compared to that during the first mode. That is, when the reference voltage variable part 740 controls the reference voltage, the driving current flowing through the first and second light-emitting diode arrays 711 and 712 included in the light source part 710 is also controlled. In addition, the reference voltage variable part 740 selectively outputs the 2D duty control signal 2D_DT or the 3D duty control signal 3D_DT provided from the timing controller 200, depending on the mode of operation.

That is, according to the embodiment of FIG. 7, both the function of boosting the driving current flowing through the first and second light-emitting diode arrays 711 and 712 and the function of selecting one of the 2D duty control signal 2D_DT and the 3D duty control signal 3D_DT are performed by the reference voltage variable part 740 as one circuit.

Figure 8:
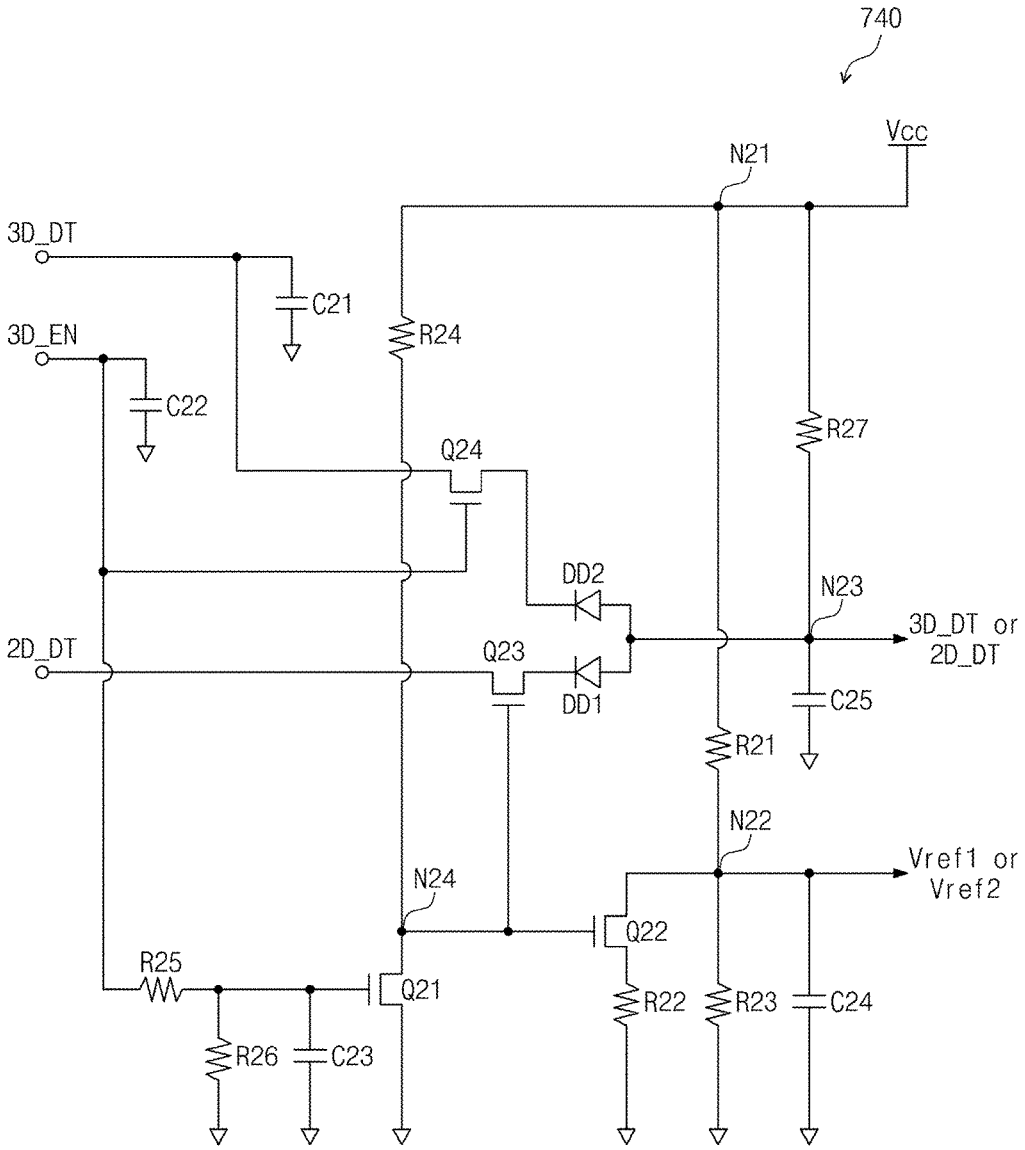
FIG. 8 is a circuit diagram of the reference voltage variable part shown in FIG. 7, according to an exemplary embodiment of the present disclosure.

FIG. 8 is a circuit diagram of the reference voltage variable part 740 shown in FIG. 7, according to an exemplary embodiment of the present disclosure. Referring to FIG. 8, the reference voltage variable part 740 includes first to fourth transistors Q21 to Q24, first and second diodes DD1 and DD2, first to seventh resistors R21 to R27, and first to fifth capacitors C21 to C25.

Each of the first to fourth transistors Q21 to Q24 may be a three-terminal device configured to include a first terminal, a second terminal, and a control terminal. Each of the first to fourth transistors Q21 and Q24 may be a field effect transistor (FET) or a bipolar junction transistor (BJT). For instance, each of the first to fourth transistors Q21 and Q24 may be a transistor having an n-channel. When each of the first to fourth transistors Q21 and Q24 is the field effect transistor, the first, second, and control terminals of each of the first to fourth transistors Q21 and Q24 are a drain terminal, a source terminal, and a gate terminal, respectively.

The first terminal of the first transistor Q21 is connected to the control terminal of the second transistor Q22. The second terminal of the first transistor Q21 is connected to the ground. The control terminal of the first transistor Q21 receives the 3D enable signal 3D_EN through the fifth resistor R25 during the second mode. The fifth resistor R25 removes noise from the 3D enable signal 3D_EN.

The second resistor R22 is connected to the first terminal of the second transistor Q22 and the ground. The first resistor R21 is connected between the second terminal of the second transistor Q22 and a first node N21 applied with the source voltage Vcc.

The first terminal of the third transistor Q23 receives the 2D duty control signal 2D_DT. The second terminal of the third transistor Q23 is connected to the first diode DD1. The control terminal of the third transistor Q23 is connected to the first terminal of the first transistor Q21 and the control terminal of the second transistor Q22.

The first terminal of the fourth transistor Q24 receives the 3D duty control signal 3D_DT. The second terminal of the fourth transistor Q24 is connected to the second diode DD2. The control terminal of the fourth transistor Q24 receives the 3D enable signal 3D_EN.

One end of the first diode DD1 is connected to the third transistor Q23 and the other end of the first diode DD1 is connected to the second diode DD2. The first diode DD1 blocks a current flowing from the first terminal of the third transistor Q23 to the second terminal of the third transistor Q23.

One end of the second diode DD2 is connected to the fourth transistor Q24 and the other end of the second diode DD2 is connected to the first diode DD1. The second diode DD2 blocks a current flowing from the first terminal of the fourth transistor Q24 to the second terminal of the fourth transistor Q24. A node between the first and second nodes DD1 and DD2 is referred to as a third node N23.

One end of the first resistor R21 is connected to the first node N21 and the other end of the first resistor R21 is connected to the second node N22 connected to the second terminal of the second transistor Q22. One end of the third resistor R23 is connected to the second node N22 and the other end of the third resistor R23 is connected to the ground.

The fourth resistor R24 is connected between the first terminal of the first transistor Q21 and the first node N21. The sixth resistor R26 is connected between the control terminal of the first transistor Q21 and the ground. The seventh resistor R27 is connected between the first node N21 and the third node N23.

The first capacitor C21 is connected between the first terminal of the fourth transistor Q24 and the ground to maintain a waveform of the 3D duty control signal 3D_DT.

The second capacitor C22 is connected between the control terminal of the fourth transistor Q24 and the ground to maintain a waveform of the 3D enable signal 3D_EN. The third capacitor C23 is connected between the control terminal of the first transistor Q21 and the ground to maintain a waveform of voltage applied to the control terminal of the first transistor Q21. The fourth capacitor C24 is connected between the second node N22 and the ground to maintain a waveform of voltage at the second node N22. The fifth capacitor C25 is connected between the third node N23 and the ground to maintain a waveform of voltage at the third node N23.

The reference voltage variable part 740 outputs either the first reference voltage Vref1 or the second reference voltage Vref2 through the second node N22.

The reference voltage variable part 740 outputs one of the 2D duty control signal 2D_DT and the 3D duty control signal 3D_DT through the third node N23.

Hereinafter, the case in which the 3D enable signal 3D_EN is not applied during the first mode is described. In this case, the first reference voltage Vref1 is output from the second node N22.

When the 3D enable signal 3D_EN is not applied, the first transistor Q21 is turned off and a fourth node N24 connected to the first terminal of the first transistor Q21 is pulled-up to the level of the source voltage Vcc. The source voltage Vcc is applied to the control terminal of the second transistor Q22, and thus the second transistor Q22 is turned on. The second and third resistors R22 and R23 are connected to each other in parallel to form the combined resistance. The combined resistance of the second and third resistors R22 and R23 is connected to the first resistor R21 in series. The first reference voltage Vref1 is determined by voltage-dividing the source voltage Vcc in accordance with the combined resistance of the second and third resistors R22 and R23 and the first resistor R21. The first reference voltage Vref1 is determined by the following equation of $Vref1=Vcc\times(R22\cdot R23)/(R22\cdot R23+R21\cdot R22+R21\cdot R23)$.

Hereinafter, the case in which the 3D enable signal 3D_EN is applied during the second mode is described. In this case, the second reference voltage Vref2 is output from the second node N22.

When the 3D enable signal 3D_EN is applied, the first transistor Q21 is turned on and the fourth node N24 connected to the first terminal of the first transistor Q21 is grounded. The control terminal of the second transistor Q22 is grounded and turned off, and thus a current does not flow through the second resistor R22. The first and third resistors R21 and R23 are connected to each other in series. The second reference voltage Vref2 is determined by voltage-dividing the source voltage Vcc in accordance with the first and third resistors R21 and R23. The second reference voltage Vref2 is determined by the following equation of $Vref2=Vcc\times R23/(R21+R23)$.

Hereinafter, the case in which 2D duty control signal 2D-DT is output from the third node N23 during the first mode is described. Here, the level of the source voltage Vcc is substantially the same as the level of the high state of the 2D duty control signal 2D_DT and the level of the high state of the 3D duty control signal 3D_DT, respectively.

When the 3D enable signal 3D_EN is not applied, the first and fourth transistors Q21 and Q24 are turned off. The fourth node N24 connected to the first terminal of the first transistor Q21 is pulled-up to the level of the source voltage Vcc. The source voltage Vcc is applied to the control terminal of the third transistor Q23, and thus the third transistor Q23 is turned on. The second terminal of the turned-on third transistor Q23 outputs the 2D duty control signal 2D_DT, and the second terminal of the turned-off fourth transistor Q24 does not output the 3D duty control signal 3D_DT.

If the third transistor Q23 is turned off or the 2D duty control signal 2D_DT is in the high state and the fourth transistor Q24 is turned off or the 3D duty control signal 3D_DT is in the high state, the third node N23 is pulled-up to the level of the source voltage Vcc. Since the third transistor Q23 is turned on, the third node N23 has the high state during the period in which the 2D duty control signal 2D_DT is in the high state and has the low state during the period in which 2D duty control signal 2D_DT is in the low state, such as shown in FIG. 3. That is, the reference voltage variable part 740 outputs the 2D duty control signal 2D_DT through the third node N23 during the first mode. As FIG. 7 shows, the output 2D duty control signal 2D_DT is applied to a node ND3 connected to the control terminal of the first current control transistor TR1.

When the 3D enable signal 3D_EN is applied, the first and fourth transistors Q21 and Q24 are turned on. The fourth node N24 connected to the first terminal of the first transistor Q21 is grounded. The control terminal of the third transistor Q23 is grounded, and thus the third transistor Q23 is turned off. The second terminal of the turned-off third transistor Q23 does not output the 2D duty control signal 2D_DT, and the second terminal of the turned-on fourth transistor Q24 outputs the 3D duty control signal 3D_DT.

If the third transistor Q23 is turned off or the 2D duty control signal 2D_DT is in the high state and the fourth transistor Q24 is turned off or the 3D duty control signal 3D_DT is in the high state, the third node N23 is pulled-up to the level of the source voltage Vcc. Since the fourth transistor Q24 is turned on, the third node N23 has the high state during the period in which the 3D duty control signal 3D_DT is in the high state and has the low state during the period in which 3D duty control signal 3D_DT is in the low state, such as shown in FIG. 3. That is, the reference voltage variable part 740 outputs the 3D duty control signal 3D_DT through the third node N23 during the second mode. As FIG. 7 shows, the output 3D duty control signal 3D_DT is applied to the node ND3 connected to the control terminal of the first current control transistor TR1.

Figure 9:
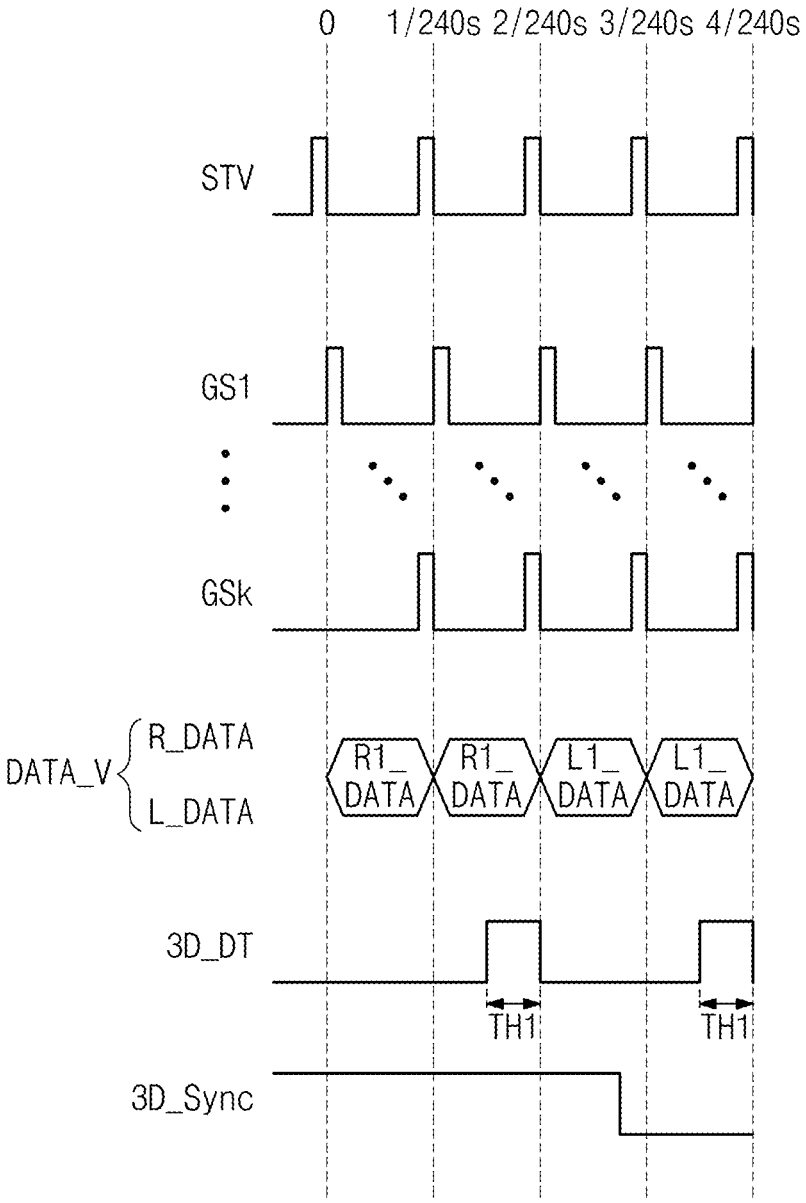
FIG. 9 is a timing diagram showing a vertical start signal, gate signals, a data voltage, a three-dimensional duty control signal, and a three-dimensional synchronization signal of a display apparatus operated in a second mode, according to an exemplary embodiment of the present disclosure.
Figure 10:
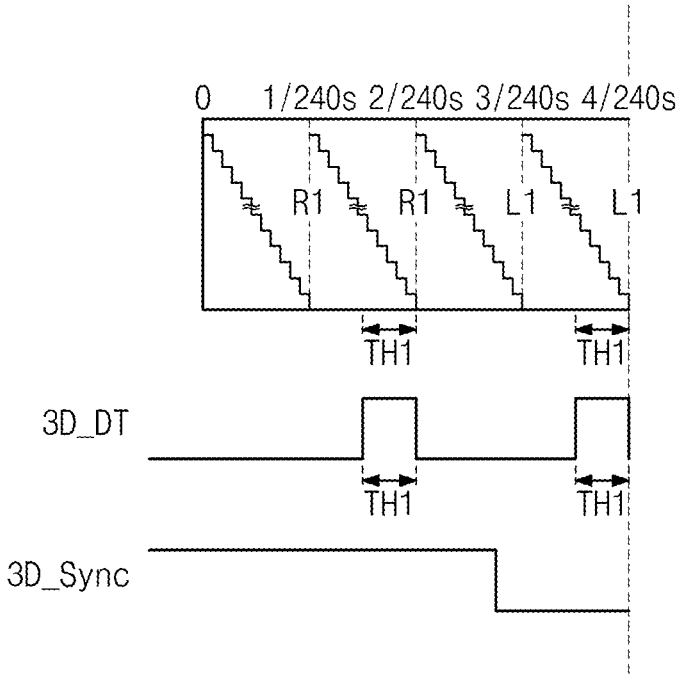
FIG. 10 is a view showing an image output from a display panel applied with the data voltage shown in FIG. 9, according to an exemplary embodiment of the present disclosure.

FIG. 9 is a timing diagram showing a vertical start signal STV, gate signals GS1 to GSk, a data voltage DATA_V, the 3D duty control signal 3D_DT, and the 3D synchronization signal 3D_sync of the display apparatus operated in the second mode, according to an exemplary embodiment of the present disclosure. FIG. 10 is a view showing an image output from the display panel 100 applied with the data voltage DATA_V shown in FIG. 9, according to an exemplary embodiment of the present disclosure.

In the exemplary embodiment of FIG. 9, the driving frequency of the display panel 100 operated in the second mode is about 240 Hz. That is, the display panel 100 displays the image corresponding to one frame period of 1/240 second.

A pulse of the vertical start signal STV is generated once every 1/240 second. After each vertical start signal STV pulse is outputted, the gate driving circuit 400 sequentially applies the gate signals GS1 to GSk to the gate lines G1 to Gk during one frame period (1/240 second).

The data voltage DATA_V includes a right-eye data voltage R_DATA and a left-eye data voltage L_DATA. The image displayed using the right-eye data voltage R_DATA is the right-eye image R1, and the image displayed using the left-eye data voltage L_DATA is the left-eye image L1.

The data driving circuit 300 successively applies each of the right-eye data voltage R_DATA and the left-eye data voltage L_DATA to the display panel 100. In the case of FIG. 9, the data driving circuit 300 alternately outputs the right-eye data voltage R_DATA and the left-eye data voltage L_DATA every two frame periods. In more detail, the right-eye data voltage R_DATA is applied to the display panel 100 during a first frame period (0 to 1/240 second), the right-eye data voltage R_DATA is applied to the display panel 100 during a second frame period (1/240 to 2/240 second), the left-eye data voltage L_DATA is applied to the display panel 100 during a third frame period (2/240 to 3/240 second), and the left-eye data voltage L_DATA is applied to the display panel 100 during a fourth frame period (3/240 to 4/240 second).

The 3D duty control signal 3D_DT has the high state during a portion of the time period in which the right-eye image R1 is displayed and a portion of the time period in which the left-eye image L1 is displayed. During the second mode, the backlight unit 500 provides the light to the display panel 100 during a period TH1 in which the 3D duty control signal 3D_DT has the high state.

The period TH1, during which the 3D duty control signal 3D_DT has the high state, coincides with a period in which only the right-eye image R1 is displayed in the display panel 100 or a period in which only the left-eye image L1 is displayed in the display panel 100. For instance, since both the right-eye image R1 and the left-eye image L1 are displayed in the third frame period (2/240 to 3/240 second), the 3D duty control signal 3D_DT has the low state during the third frame period (2/240 to 3/240 second). In FIGS. 9 and 10, the period TH1, during which the 3D duty control signal 3D_DT has the high state, coincides with at least a portion of the second frame period (1/240 to 2/240 second) and at least a portion of the fourth frame period (3/240 to 4/240).

The state, i.e., level, of the 3D synchronization signal 3D_sync transitions during the period in which the 3D duty control signal 3D_DT has the low state. In FIGS. 9 and 10, when the 3D synchronization signal 3D_sync has the high state, the shutter glasses 600 open the right-eye shutter. Conversely, when the 3D synchronization signal 3D_sync has the low state in FIGS. 9 and 10, the shutter glasses 600 open the left-eye shutter.

Figure 11:
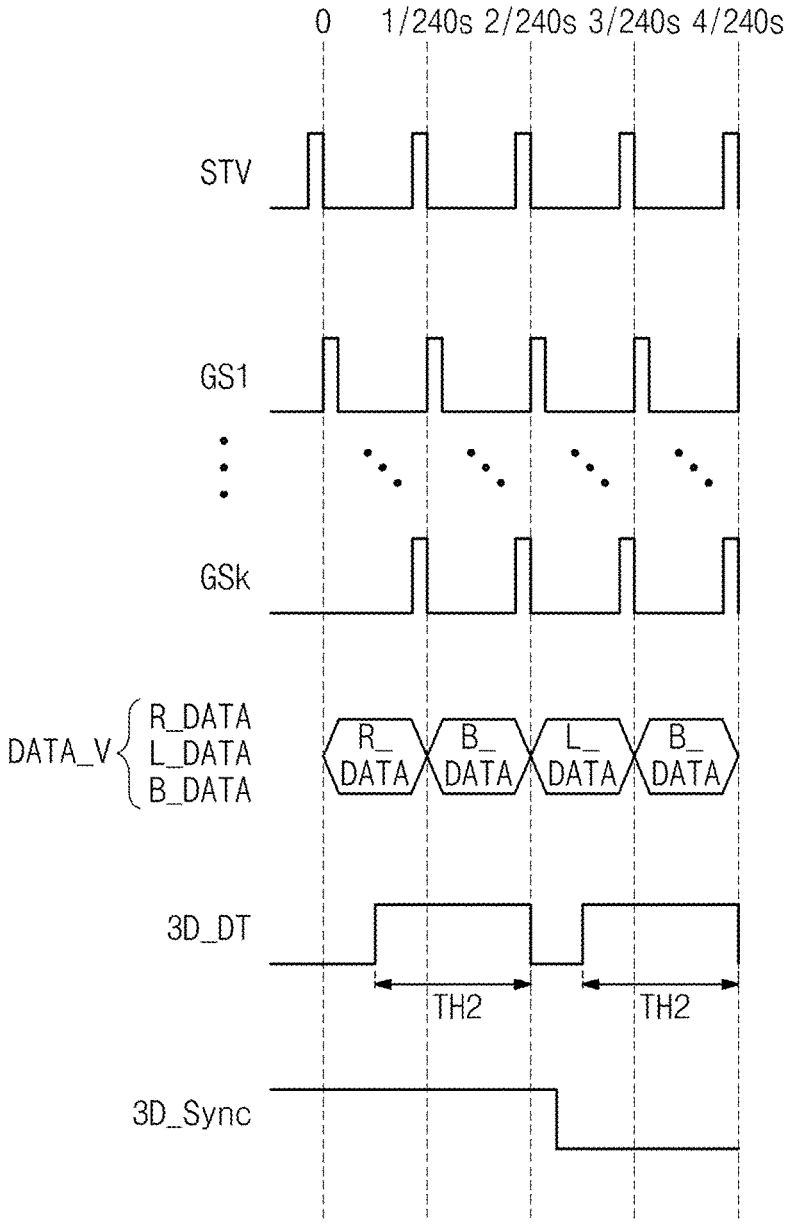
FIG. 11 is a timing diagram showing a vertical start signal, gate signals, a data voltage, a three-dimensional duty control signal, and a three-dimensional synchronization signal of a display apparatus operated in a second mode, according to another exemplary embodiment of the present disclosure.
Figure 12:
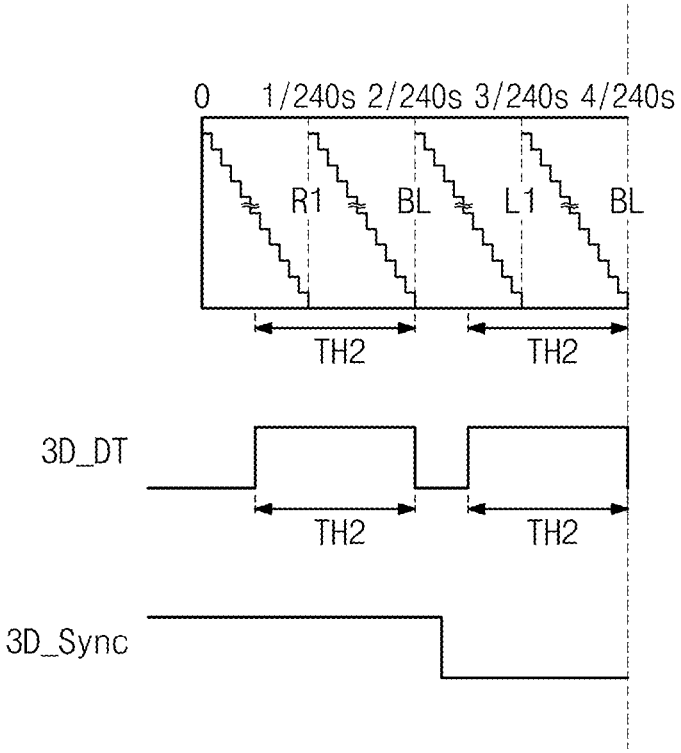
FIG. 12 is a view showing an image output from a display panel applied with the data voltage shown in FIG. 11, according to an exemplary embodiment of the present disclosure.

FIG. 11 is a timing diagram showing a vertical start signal STV, gate signals GS1 to GSk, a data voltage DATA_V, a 3D duty control signal 3D_DT, and a 3D synchronization signal 3D_sync of a display apparatus operated in a second mode, according to another exemplary embodiment of the present disclosure. FIG. 12 is a view showing an image output from a display panel 100 applied with the data voltage DATA_V shown in FIG. 11.

The vertical start signal STV and the gate signals GS1 to GSk shown in FIGS. 11 and 12 are substantially the same as those described with reference to FIGS. 9 and 10. Thus detailed descriptions of the vertical start signal STV and the gate signals GS1 to GSk shown in FIGS. 11 and 12 are omitted.

Referring to FIGS. 1, 11, and 12, the data voltage DATA_V includes a right-eye data voltage R_DATA, a left-eye data voltage L_DATA, and a black data voltage B_DATA. The image displayed using the right-eye data voltage R_DATA is the right-eye image R1, the image displayed using the left-eye data voltage L_DATA is the left-eye image L1, and the image displayed using the black data voltage B_DATA is a black image BL.

The data driving circuit 300 alternately outputs the right-eye data voltage R_DATA and the left-eye data voltage L_DATA and outputs the black data voltage B_DATA between the alternations. In more detail, the right-eye data voltage R_DATA is applied to the display panel 100 during a first frame period (0 to 1/240 second), the black data voltage B_DATA is applied to the display panel 100 during a second frame period (1/240 to 2/240 second), the left-eye data voltage L_DATA is applied to the display panel 100 during a third frame period (2/240 to 3/240 second), and the black data voltage B_DATA is applied to the display panel 100 during a fourth frame period (3/240 to 4/240 second).

The 3D duty control signal 3D_DT has the high state during a portion of the time period in which the right-eye image R1 and the black image BL are displayed. In addition, the 3D duty control signal 3D_DT has the high state during a portion of the time period in which the left-eye image L1 and the black image BL are displayed. During the second mode, the backlight unit 500 provides the light to the display panel 100 during a period TH2 in which the 3D duty control signal 3D_DT has the high state.

During the period TH2 in which the 3D duty control signal 3D_DT has the high state, the right-eye image R1 and the black image BL are displayed in the display panel 100, or the left-eye image L1 and the black image BL are displayed in the display panel 100. The right-eye image R1 and the left-eye image L1, however, may not be displayed during the same period TH2 in which the 3D duty control signal 3D_DT has the high state. Accordingly, the 3D duty control signal 3D_DT may not have the high state during two successive frame periods in terms of time, e.g., the second and third frame periods (1/240 to 2/240 second and 2/240 to 3/240 second), which are successive.

The state (level) of the 3D synchronization signal 3D_sync transitions in the period in which the 3D duty control signal 3D_DT has the low state. In FIGS. 11 and 12, when the 3D synchronization signal 3D_sync has the high state, the shutter glasses 600 open the right-eye shutter. Conversely, when the 3D synchronization signal 3D_sync has the low state in FIGS. 11 and 12, the shutter glasses 600 open the left-eye shutter.

Figure 13:
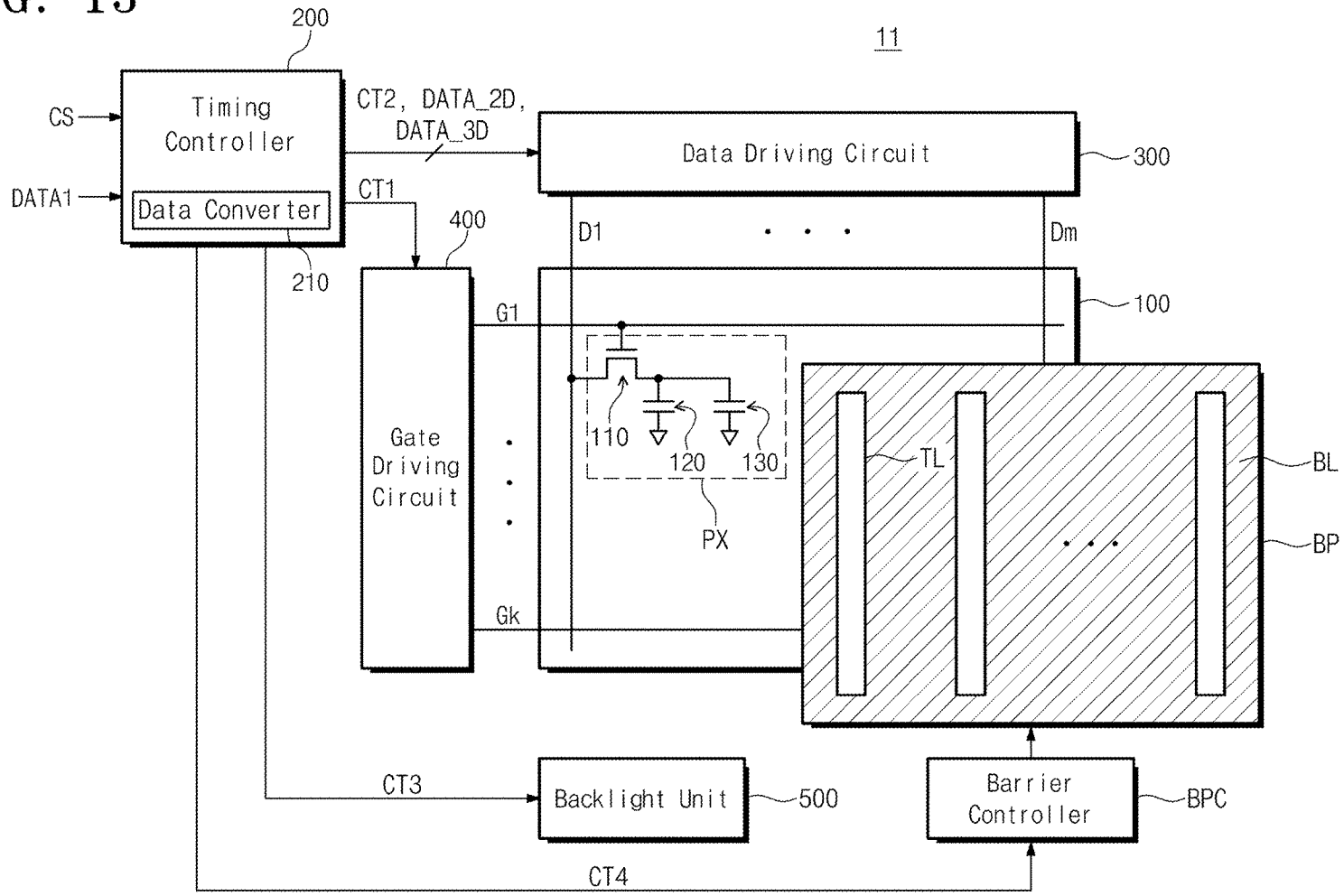
FIG. 13 is a block diagram of a three-dimensional image system, according to another exemplary embodiment of the present disclosure.

FIG. 13 is a block diagram of a 3D image system 11, according to another exemplary embodiment of the present disclosure.

Referring to FIG. 13, the 3D image system 11 includes a display panel 100, a timing controller 200, a data driving circuit 300, a gate driving circuit 400, a backlight unit 500, a barrier panel BP, and a barrier controller BPC. The 3D image system 11 shown in FIG. 13 is substantially the same as the 3D image system 10 shown in FIG. 1 except that the shutter glasses 600 are removed from the 3D image system 11, and the barrier panel BP and the barrier controller BPC are added to the 3D image system 11. Therefore, hereinafter, the barrier panel BP and the barrier controller BPC are described in detail, and detailed descriptions of the display panel 100, the timing controller 200, the data driving circuit 300, the gate driving circuit 400, and the backlight unit 500 are omitted.

The barrier panel BP is disposed on the display panel 101 and includes a light transmitting part TL and a light blocking part BL. The barrier panel BP controls a position and a size of the light transmitting part TL and the light blocking part BL. The light transmitting part TL transmits the light incident thereto and the light blocking part BL blocks the light incident thereto.

The barrier panel BP provides the 2D image to the viewer through the light transmitting part TL during the first mode. In the second mode, the barrier panel BP provides the left-eye image to the viewer during the left-eye frame period and provides the right-eye image to the viewer during the right-eye frame period.

The barrier panel BP may be, but not limited to, an active barrier panel having two substrates and a liquid crystal layer disposed between the two substrates.

The barrier controller BPC receives a barrier control signal CT4 from the timing controller 201. The barrier control signal CT4 includes a signal indicating a first mode operation of the barrier panel BP, a signal indicating a second mode operation of the barrier panel BP, and a 3D synchronization signal synchronized with a driving timing of the display panel 101 operated in the second mode. The barrier controller BPC controls the position and the size of the light transmitting part TL and the light blocking part BL in response to the barrier control signal CT4.

Although the exemplary embodiments of the present system and method have been described, the present system and method are not limited to these exemplary embodiments. Rather, various changes and modifications can be made by one of ordinary skill in the art within the spirit and scope of the present system and method.

What is claimed is:

1. A backlight unit comprising:

a light source part having a light-emitting diode array;

a DC/DC converter configured to apply a driving voltage to the light-emitting diode array;

a driving current controller configured to control a driving current flowing through the light-emitting diode array to have a first current level during a first mode and control the driving current flowing through the light-emitting diode array to have a second current level different from the first current level during a second mode different from the first mode; and a reference voltage variable part configured to apply a first reference voltage to the driving current controller during the first mode and apply a second reference voltage different from the first reference voltage to the driving current controller during the second mode, the driving current controller comprising:

a current control transistor having a first terminal connected to the light-emitting diode array;

an amplifier having a first input terminal connected to a second terminal of the current control transistor, a second input terminal connected to the reference voltage variable part, and an output terminal connected to a control terminal of the current control transistor; and a resistor connected to the second terminal of the current control transistor, wherein the reference voltage variable part comprises:

a first reference resistor configured to receive a source voltage through one end thereof;

a second reference resistor connected between another end of the first reference resistor and a ground;

a switching device connected to the second reference resistor in series between the other end of the first reference resistor and the ground; and a third resistor connected to the second reference resistor and the switching device in parallel between the other end of the first reference resistor and the ground, and a voltage of the other end of the first reference resistor is output as the first reference voltage or the second reference voltage according to an ON or OFF operation of the switching device.

2. The backlight unit of claim 1, wherein the first reference voltage has a voltage level lower than a voltage level of the second reference voltage and the first current level is lower than the second current level.

3. The backlight unit of claim 1, wherein the resistor has a constant resistance.

4. The backlight unit of claim 1, wherein the light-emitting diode array comprises a first light-emitting diode array and a second light-emitting diode array connected to the first light-emitting diode array in parallel.

5. The display apparatus of claim 4, wherein the current control transistor comprises a first current control transistor having a first terminal connected to the first light-emitting diode array and a second current control transistor having a first terminal connected to the second light-emitting diode array, the amplifier comprises:

a first amplifier having a first input terminal connected to a second terminal of the first current control transistor, a second input terminal connected to the reference voltage variable part, and an output terminal connected to a control terminal of the first current control transistor; and a second amplifier having a first input terminal connected to a second terminal of the second current control transistor, a second input terminal connected to the reference voltage variable part, and an output terminal connected to a control terminal of the second current control transistor, and the second input terminal of the first amplifier is electrically connected to the second input terminal of the second amplifier.

6. The backlight unit of claim 5, wherein the resistor comprises:

a first resistor connected to the second terminal of the first current control transistor; and a second resistor connected to the second terminal of the second current control transistor, and the first and second resistors have the same resistance.

7. The backlight unit of claim 1, wherein the driving current controller is further configured to receive a first duty control signal during the first mode and a second duty control signal during the second mode, the second duty control signal has a duty ratio smaller than a duty ratio of the first duty control signal, and a period in which the driving current flows through the light-emitting diode array is controlled in accordance with the duty ratio of the first duty control signal and the second duty control signal.

8. The backlight unit of claim 1, wherein the reference voltage variable part is further configured to:

receive a first duty control signal and a second duty control signal having a duty ratio smaller than a duty ratio of the first duty control signal, apply the first duty control signal to the driving current controller during the first mode, and apply the second duty control signal to the driving current controller during the second mode.

9. A backlight unit comprising:

a light source part having a light-emitting diode array;

a DC/DC converter configured to apply a driving voltage to the light-emitting diode array;

a driving current controller configured to control a driving current flowing through the light-emitting diode array to have a first current level during a first mode and control the driving current flowing through the light-emitting diode array to have a second current level different from the first current level during a second mode different from the first mode; and a reference voltage variable part configured to apply a first reference voltage to the driving current controller during the first mode and apply a second reference voltage different from the first reference voltage to the driving current controller during the second mode, the driving current controller comprising:

a current control transistor having a first terminal connected to the light-emitting diode array;

an amplifier having a first input terminal connected to a second terminal of the current control transistor, a second input terminal connected to the reference voltage variable part, and an output terminal connected to a control terminal of the current control transistor; and a resistor connected to the second terminal of the current control transistor, wherein the reference voltage variable part comprises:

a first transistor having a control terminal configured to receive an enable signal during the second mode and a first terminal connected to a ground;

a second transistor having a control terminal connected to a second terminal of the first transistor and a first terminal connected to the ground;

a first resistor having one end connected to a first node configured to receive a source voltage;

a second resistor having one end directly connected to another end of the first resistor and another end connected to the second terminal of the second transistor; and a third resistor directly connected between the ground and a second node between the first and second resistors.

10. The backlight unit of claim 9, wherein the reference voltage variable part is further configured to output the first reference voltage through the second node during the first mode and output the second reference voltage through the second node during the second mode.

11. A backlight unit comprising:

a light source part having a light-emitting diode array;

a DC/DC converter configured to apply a driving voltage to the light-emitting diode array;

a driving current controller configured to control a driving current flowing through the light-emitting diode array to have a first current level during a first mode and control the driving current flowing through the light-emitting diode array to have a second current level different from the first current level during a second mode different from the first mode; and a reference voltage variable part configured to apply a first reference voltage to the driving current controller during the first mode and apply a second reference voltage different from the first reference voltage to the driving current controller during the second mode, the driving current controller comprising:

a current control transistor having a first terminal connected to the light-emitting diode array;

an amplifier having a first input terminal connected to a second terminal of the current control transistor, a second input terminal connected to the reference voltage variable part, and an output terminal connected to a control terminal of the current control transistor; and a resistor connected to the second terminal of the current control transistor, wherein the reference voltage variable part comprises:

a first transistor having a control terminal configured to receive an enable signal during the second mode and a first terminal connected to a ground;

a second transistor having a control terminal connected to a second terminal of the first transistor;

a first resistor connected between a first terminal of the second transistor and a first node configured to receive a source voltage;

a second resistor directly connected between a second terminal of the second transistor and the ground; and a third resistor directly connected between a second node connected to the first terminal of the second transistor and the ground.

12. The backlight unit of claim 11, wherein the reference voltage variable part is further configured to output the first reference voltage through the second node during the first mode and output the second reference voltage through the second node during the second mode.

13. The backlight unit of claim 11, wherein the reference voltage variable part further comprises:

a third transistor having a control terminal connected to the control terminal of the second transistor and a first terminal configured to receive a first duty control signal;

a fourth transistor having a control terminal configured to receive the enable signal during the second mode and a first terminal configured to receive the second duty control signal;

a first diode having one end connected to a second terminal of the third transistor and configured to block a current flowing from the first terminal of the third transistor to the second terminal of the third transistor through the third transistor; and a second diode having one end connected to a second terminal of the fourth transistor and another end connected to the first diode and configured to block a current flowing from the first terminal of the fourth transistor to the second terminal of the third transistor.

14. The backlight unit of claim 13, wherein the reference voltage variable part is further configured to output the first duty control signal through a third node between the first diode and the second diode during the first mode and output the second duty control signal through the third node during the second mode.

* * * * *